US005606622A

United States Patent [19]

Christenson

[11] Patent Number: 5,606,622

[45] Date of Patent: Feb. 25, 1997

[54] ACTIVE NOISE CONTROL IN A DUCT WITH HIGHLY TURBULENT AIRFLOW

[75] Inventor: Terry N. Christenson, Seattle, Wash.

[73] Assignee: The Boeing Company, Seattle, Wash.

[21] Appl. No.: 315,011

[22] Filed: Sep. 29, 1994

[51] Int. Cl.[6] ..... G10K 11/16

[52] U.S. Cl. ..... 381/71

[58] Field of Search ..... 415/119; 381/71

[56] References Cited

U.S. PATENT DOCUMENTS

| | | | |
|---|---|---|---|
| 3,936,606 | 2/1976 | Wanke | 381/71 |
| 4,044,203 | 8/1977 | Swinbanks | 381/71 |
| 4,122,674 | 10/1978 | Andersson et al. | 60/39.65 |
| 4,815,139 | 3/1989 | Eriksson et al. | 381/71 |
| 5,215,454 | 6/1993 | Ferramola et al. | 431/2 |
| 5,339,287 | 8/1994 | Bauer | 381/86 |

FOREIGN PATENT DOCUMENTS

| | | | |
|---|---|---|---|
| 0454341A3 | 10/1991 | European Pat. Off. . | |
| 3-13997 | 1/1991 | Japan | 381/71 |
| 3-188798 | 8/1991 | Japan | 381/71 |
| 5-188976 | 7/1993 | Japan . | |
| 7-168585 | 4/1995 | Japan . | |
| WO95/19075 | 7/1995 | WIPO . | |

*Primary Examiner*—Forester W. Isen
*Attorney, Agent, or Firm*—Conrad O. Gardner

[57] ABSTRACT

A system for providing active noise control for turbulent airflow in a duct utilizing flow straightening upstream of bullet shaped microphones coupled to the noise control electronics thereby improving noise coherence between the input and error microphones and achieving noise reduction.

3 Claims, 1 Drawing Sheet

Fig. 1.
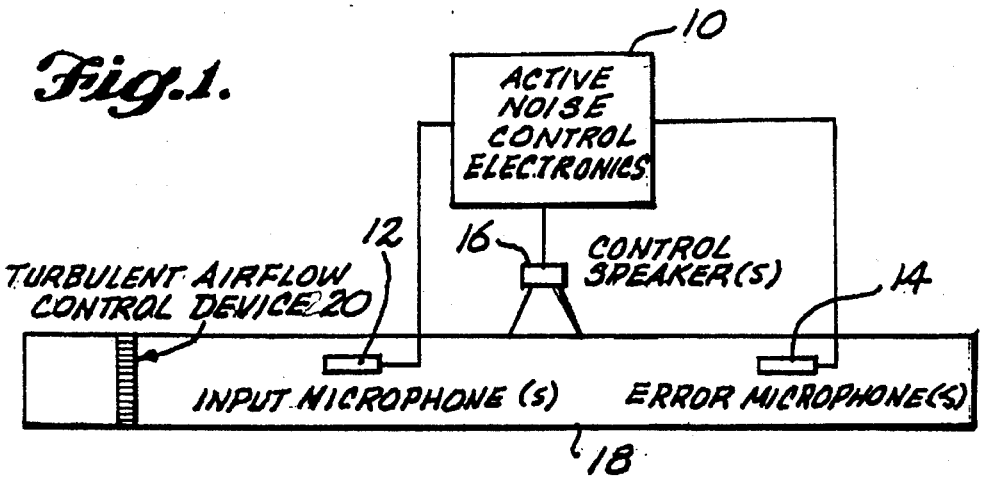
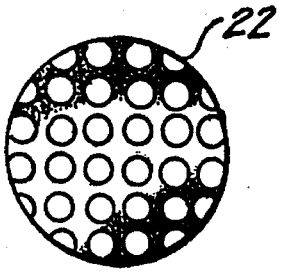
Fig. 2.
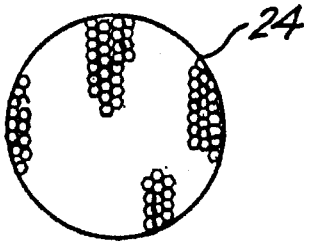
Fig. 3.
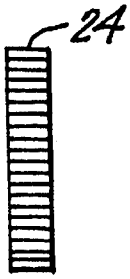
Fig. 4.
Fig. 5.
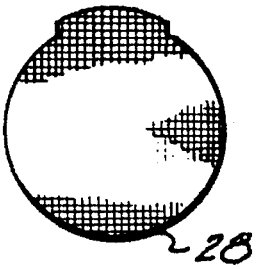
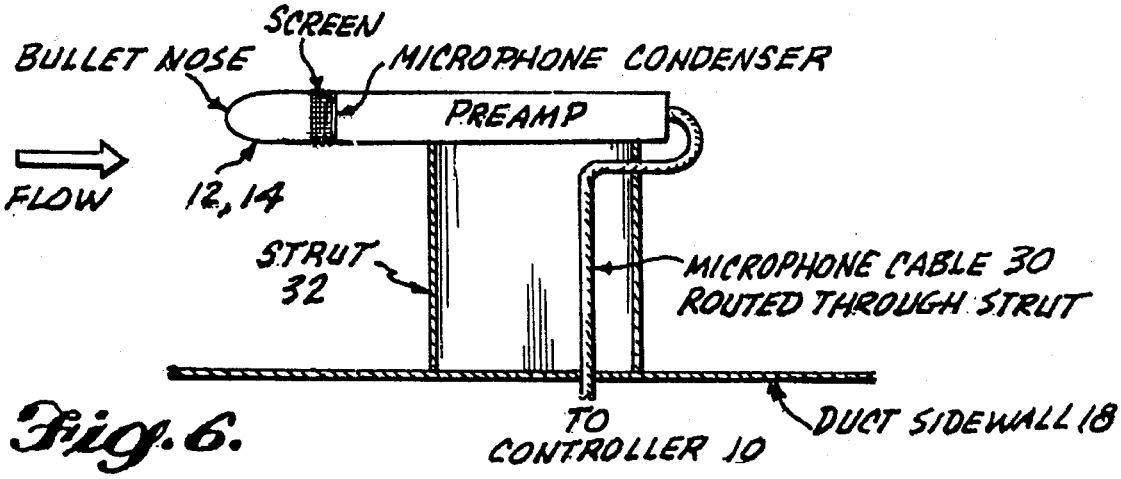
Fig. 6.

ACTIVE NOISE CONTROL IN A DUCT WITH HIGHLY TURBULENT AIRFLOW

TECHNICAL FIELD

The present invention relates generally to noise reduction systems, and more particularly to active noise cancellation in a duct with highly turbulent airflow.

BACKGROUND ART

In the patent literature, active noise control in a jet engine is shown in U.S. Pat. No. 4,044,203 to Swinbanks. Swinbanks describes the method of arranging microphones and speakers in both the inlet and exhaust ducts of a jet engine as well as ducts in general such that the resultant output of the speakers will cancel the desired noise without emitting noise itself in the opposite direction. The arrangement also ensures that there is no feedback from the speakers to the microphones.

U.S. Pat. No. 4,815,139 (L. J. Eriksson, et al.) from Col. 1, line 64 through Col. 2, line 22 discusses the possibility of splitting the duct to increase the transverse resonant frequency and thus allow the active noise control system to work at higher frequencies.

U.S. Pat. No. 5,119,902 (Earl R. Geddes) discloses a system for modifying the duct to form an efficient speaker enclosure so that sufficient acoustic power can be applied in a small enough package to provide attenuation in the automobile exhaust system, however not involving the use of flow straighteners.

SUMMARY OF THE INVENTION

The present invention utilizes a method of providing active noise control for turbulent airflow in a duct. This has been difficult because the variations in frequency with position and the interactions of the airflow with the microphones caused by large scale turbulence have made the feedback cancellation systems ineffective. The present invention utilizes a flow straighteners (honeycomb sections with or without an upstream perforated plate) upstream of the microphones to remove the large scale turbulence. Bullet microphones are used to help minimize the interaction between the microphones and the airstream.

BRIEF DESCRIPTION OF THE DRAWINGS

The present invention will be more clearly understood by reference to the following detailed description when read in conjunction with the accompanying drawing in which like reference characters refer to like parts throughout the views and in which:

FIG. 1 is a diagrammatic view of the present active noise control muffler utilizing a turbulent flow control device;

FIG. 2 is a front view of a perforated plate with face perpendicular to flow utilized as a turbulent airflow control device in the system of FIG. 1;

FIG. 3 is a front view of a honeycomb section with face perpendicular to flow utilized as a turbulent airflow control device in the active noise control system of FIG. 1;

FIG. 4 is illustrative of the thickness of the honeycomb device of FIG. 3;

FIG. 5 is a front view of a screen structure with face perpendicular to flow suitable for use as a turbulent airflow control device in the active noise control system of FIG. 1; and FIG. 6 is a diagrammatic view of the input and error microphones of FIG. 1 showing bullet nose shaped profile.

DETAILED DESCRIPTION OF THE BEST MODE

First, it must be recognized that active noise cancellation (ANC) in a duct with high turbulence is difficult to achieve. Noise created by the interaction of the turbulent flow and the microphones results in low coherence between the input microphone and the error microphone. The present system utilizes flow straightener devices e.g., perforated plates, screens, honeycomb material, and/or the combination of the honeycomb and screen/plate to smooth the airflow upstream of the input microphone. Bullet microphones are also used to limit the interaction of the microphones with the airflow.

The present system (Turbulent Airflow Control Device and Bullet Microphones) results in high coherence which enables the ANC system to reduce the sound pressure level of noise traveling through the ducting. Noise reduction using this system has been demonstrated for duct air velocities up to 7000 feet per minute.

A schematic of the present system is shown in FIG. 1. An active noise system controller 10 is coupled to input microphone(s) 12, error microphone(s) 14 and control speaker(s) 16 disposed in duct 18.

Turbulent airflow control device 20 removes large structured turbulence moving parallel to the duct 18 sidewalls and/or the swirling of air in duct 18 tangential to duct 18 sidewalls. Test results indicate that the coherence between microphones 12 and 14 improves significantly when perforated plate 22 (FIG. 2) is installed upstream of input microphone 12. The coherence is even better when honeycomb section 24 (FIGS. 3 and 4) is attached to perforated plate 22. A honeycomb section 24 with a $L/D \leqq 2$ is recommended (L: length of the honeycomb section and D: average cell diameter).

A significant improvement in coherence is also observed with just honeycomb section 24 installed. The pressure loss associated with honeycomb section 24 is significantly less than that of the perforated plate 24 screen 28 (of FIG. 3) or the combination of plate 22 screen 28 and honeycomb section 24.

Perforated plate 22 breaks up turbulence with large structure that is moving down duct 18 and weak swirls that exists in duct 18. Honeycomb section 24 removes both weak and strong swirls. Installation of both perforated plate 22 and honeycomb section 24 removes both phenomena. Removal of this turbulence significantly reduces the amount of noise created by the interaction of the airflow with the microphones and their support structure. A bullet microphone having an aerodynamic design is also crucial. This insures that any noise created by airflow past the microphone is minimized and that the microphone measures only the sound pressure levels of sound waves propagating down the duct. This results in high coherence which is required to achieve significant noise reduction using ANC.

Key components of the present system include:

A. Turbulent Airflow Control Device. Perforated plate, wire screen, honeycomb material, or combination utilized to smooth the turbulent air moving through the duct. This enables the microphones to measure sound waves propagating in the duct rather than the sound waves generated due to the interaction of the microphones with the turbulent flow.

B. Bullet Microphones (12 and 14). Microphone with "bullet" style nose cone 44 (FIG. 6) and preamp supported by strut to duct sidewall 18 (see FIG. 5). Microphone cable 30 is routed through strut 32. This system does not generate noise when placed in smooth, turbulence free airflow, enabling the measurement of sound waves propagating down the duct.

C. Active noise controller 10 which generates an anti noise acoustic field utilizing control speaker(s) 16 which cancels the noise acoustic field and results in a quiet space. Active noise controller 10 is responsive to inputs from two sensing microphone(s) viz, input microphone(s) 12 and error microphone(s) 14. Active noise controller 10 may comprise e.g., a module dX-57 sound and vibration controller of Nelson Industries, Inc. of Stoughton, Wis.

Coherence Measurements & Methods to Improve Coherence

As mentioned earlier, the key to achieving noise reduction using ANC is the coherence between the input microphone and the error microphone. Baseline coherence measurements were found to be low and deteriorated as duct air velocity increased. This deterioration of coherence is due to noise created by the interaction of the turbulent flow with the microphones and microphone support strut. Flow straightener devices such as perforated plates, honeycomb material, and/or the combination of the honeycomb and plates were used to smooth the airflow upstream of the input microphone.

Test results indicate that the coherence between the microphones improves significantly when a perforated plate (metal screen with 0.06 inch diameter holes with hexagonal pattern centers spaced by 0.09 inches was tested) is installed upstream of the input microphone. The coherence is even better when a honeycomb section is attached to the perforated plate. A honeycomb section with a $L/D \geqq 2$ is recommended (where L: is the length of the honeycomb section and D: is the average cell diameter). The honeycomb section tested a cell length 2 inches, an average cell diameter of ¼ inch, and a L/D ratio of 8. A significant improvement in coherence is also observed with just the honeycomb section installed. The pressure loss associated with the honeycomb section is significantly less than that of the perforated plate/screen or the combination of plate/screen and honeycomb section. The honeycomb only configuration is the preferred configuration due to its low pressure drop.

Flow straightener devices remove large structured turbulence moving parallel to the duct sidewalls and/or the swirling of air in the duct tangential to the duct sidewalls. The perforated plate breaks up turbulence with large structure that is moving down the duct and weak swirls that exists in the duct. The honeycomb section removes both weak and strong swirls. Installation of both the perforated plate and honeycomb section removes both phenomena.

Removal of turbulence significantly reduces the amount of noise created by the interaction of the airflow with the microphone and its support structure. A bullet microphone with an aerodynamic design as shown in FIG. 6 is also crucial. This insures that any noise created by airflow past the microphone is minimized and that the microphone measures only the sound pressure levels of sound waves propagating down the duct. This results in high coherence with as stated earlier is required to achieve significant noise reduction using ANC.

Predicted & Measured Noise Reduction

An estimation of the noise reduction possible can be calculated using equation (1), if the coherence is known. The estimated noise reductions were calculated and are $$\Delta dB = 10 \log (1-\gamma^2(\omega)). \quad (1).$$

Broad band noise reduction of 20 to 25 dB is predicted for the honeycomb plus perforated screen configuration. The honeycomb only and perforated plate only configurations noise reductions are estimated to be around 10 to 15 dB.

Now with a configuration where the coherence is high and the pressure drop is low, it can be seen how much noise reduction the present ANC system can provide. Sound pressure levels measured at the error microphone with a speaker as the noise source and a duct air velocity of 1000 fpm are 15 to 20 dB less when the ANC is turned on. The theoretical attenuation closely matches the attenuation provided by the ANC system when speakers are used as the noise source. When turbulent mixing of air is the noise source, 8 to 12 dB of attenuation is achieved.

With a duct air velocity of 3000 fpm, the theoretical reduction is 10–15 dB. The attenuation achieved with the speaker as the noise source provides attenuation similar to the theoretical reduction. However, in the 200 to 300 Hertz frequency range, the theoretical attenuation is approximately 5 dB better than what is actually achieved. When the turbulent mixing of air source is used, the attenuation is 8 to 11 dB in the 200 to 300 Hertz range, and approximately 5 dB between 300 to 400 Hz.

The ANC system did not perform as well as predicted when the duct air velocity is 5000 fpm. Noise attenuations ranging between 12 and 20 dB are predicted. Actual noise attenuation achieved when the speaker is the noise source is 8 to 12 dB between 350 and 400 Hz. At all other frequencies the attenuation is nearly identical to the attenuation achieved with turbulent mixing of air as the noise source and is only 4 to 5 dB.

What is claimed:

1. In combination in an active noise cancellation system in a duct having an input microphone, a control speaker, and an error microphone;

a turbulent airflow control device disposed upstream in said duct from said input microphone;

said input microphone and said error microphone having bullet shaped profiles;

the combination wherein said turbulent airflow control device comprises a perforated plate wherein a honeycomb section is attached to said perforated plate.

2. In combination in an active noise cancellation system in a duct having an input microphone, a control speaker, and an error microphone;

a turbulent airflow control device disposed upstream in said duct from said input microphone;

said input microphone and said error microphone having bullet shaped profiles;

the combination wherein said turbulent airflow control device comprises a perforated plate wherein a honeycomb section is attached to said perforated plate wherein said honeycomb section has a dimension $L/D \geqq 2$ where L is the length of said honeycomb section and D is the average cell diameter.

3. In combination in an active noise control system having an input microphone disposed in a duct, said input microphone coupled to an active noise controller;

a turbulent airflow control device for removing large structured turbulence moving parallel to the sidewalls of said duct and the swirling of air in he said duct tangential to the sidewalls of said duct, said turbulent airflow control device disposed in said duct upstream from said input microphone wherein said turbulent airflow control device comprises a perforated plate and a honeycomb section.

* * * * *